US006763688B1

(12) United States Patent
Syu

(10) Patent No.: US 6,763,688 B1
(45) Date of Patent: Jul. 20, 2004

(54) MULTIFUNCTIONAL COMPUTER LOCK

(76) Inventor: Jing Shu Syu, No. 311, Yongchen N. Rd., Taiping City, Taichung County (TW), 411

( * ) Notice: Subject to any disclaimer, the term of this patent is extended or adjusted under 35 U.S.C. 154(b) by 0 days.

(21) Appl. No.: 10/678,108

(22) Filed: Oct. 6, 2003

(51) Int. Cl.[7] ..... E05B 73/00
(52) U.S. Cl. ..... 70/14; 70/19; 70/58; 248/553
(58) Field of Search ..... 70/14, 18, 19, 70/58, 62; 248/551, 553

(56) References Cited

U.S. PATENT DOCUMENTS 6,006,557 A * 12/1999 Carl et al. ..... 70/58
6,105,922 A * 8/2000 Derman ..... 248/551
6,244,082 B1 * 6/2001 Avganim ..... 70/58
6,536,244 B1 * 3/2003 Chang ..... 70/58
6,601,416 B1 * 8/2003 Sanders ..... 70/58
6,622,532 B2 * 9/2003 Hsu ..... 70/14
6,705,133 B1 * 3/2004 Avganim ..... 70/14
2003/0200775 A1 * 10/2003 Yu ..... 70/58
2004/0016270 A1 * 1/2004 Kuo ..... 70/58

* cited by examiner

*Primary Examiner*—Lloyd A. Gall
(74) *Attorney, Agent, or Firm*—Rosenberg, Klein & Lee

(57) ABSTRACT

A computer lock includes a lock body, a cover, a lock core, an action body, an action shaft, and a locking block. Thus, the computer lock is used for securing the notebook computer to an article, such as a fixed upright or leg, thereby providing an anti-theft function to protect the notebook computer efficiently. In addition, the computer lock is operated easily and conveniently, thereby facilitating the user operating the computer lock.

11 Claims, 8 Drawing Sheets

MULTIFUNCTIONAL COMPUTER LOCK

BACKGROUND OF THE INVENTION

1. Field of the Invention

The present invention relates to a multifunctional computer lock, and more particularly to a lock for securing an object, such as the notebook computer or the like.

2. Description of the Related Art

A conventional computer lock is used for securing the notebook computer to an article, such as a fixed upright or leg, thereby providing an anti-theft function so as to protect the notebook computer. However, the conventional computer lock cannot be operated easily and conveniently, thereby causing inconvenience to the user in operating the computer lock. In addition, the conventional computer lock has a complicated construction, thereby increasing costs of fabrication.

SUMMARY OF THE INVENTION

The present invention is to mitigate and/or obviate the disadvantage of the conventional computer lock.

The primary objective of the present invention is to provide a computer lock for securing an object, such as the notebook computer or the like.

Another objective of the present invention is to provide a computer lock that can be operated easily and conveniently, thereby facilitating the user operating the computer lock.

A further objective of the present invention is to provide a computer lock that can provide an anti-theft function so as to protect the notebook computer efficiently.

A further objective of the present invention is to provide a computer lock that has a simplified construction, thereby decreasing costs of fabrication.

In accordance with the present invention, there is provided a computer lock, comprising a lock body, a cover, a lock core, an action body, an action shaft, and a locking block, wherein:

the lock body has an irregular shape, and has an inside formed with a channel, the lock body has a periphery formed with two U-shaped receiving slots for receiving a power supply cord and other cord, the periphery of the lock body is formed with an insertion hole for insertion of a slide, the lock body has an end face formed with a shaft hole for mounting a pivot shaft and a receiving hole for receiving a spring and a pin, the lock body has a side face formed with a groove for mounting a locking cord;

the cover is pivotally mounted on the lock body by the pivot shaft, the cover has a first side formed with a first recessed zone for mounting a pad and a second side formed with a second recessed zone, the cover has a center formed with a through hole and two symmetrical protruding limit bars surrounding the through hole;

the lock core is movably mounted on the lock body, and has an end formed with a protruding catch flange for stopping the locking cord, the lock core has an inner wall formed with a slide slot for slidably mounting the slide of the lock body;

the action body is rotatably mounted in the lock core and has a periphery formed with an insertion hole for insertion of a locking pin;

the action shaft is secured on the action body to rotate therewith, and has a first end formed with a through hole for passage of the locking pin and a second end formed with an enlarged locking block; and the locking block is secured in the lock core and rested on the action body for limiting movement of the action body.

Further benefits and advantages of the present invention will become apparent after a careful reading of the detailed description with appropriate reference to the accompanying drawings.

DETAILED DESCRIPTION OF THE INVENTION

Figure 1:
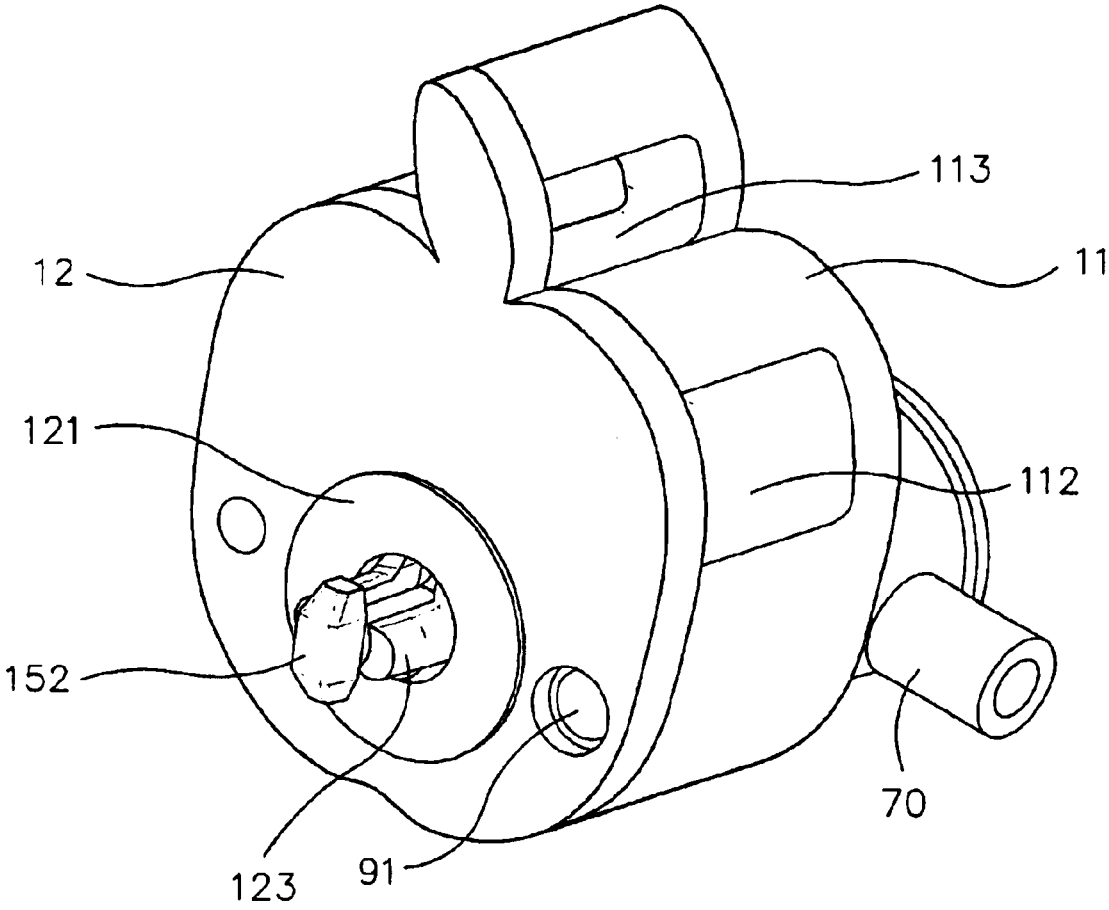
FIG. 1 is a perspective view of a computer lock in accordance with the preferred embodiment of the present invention.
Figure 2:
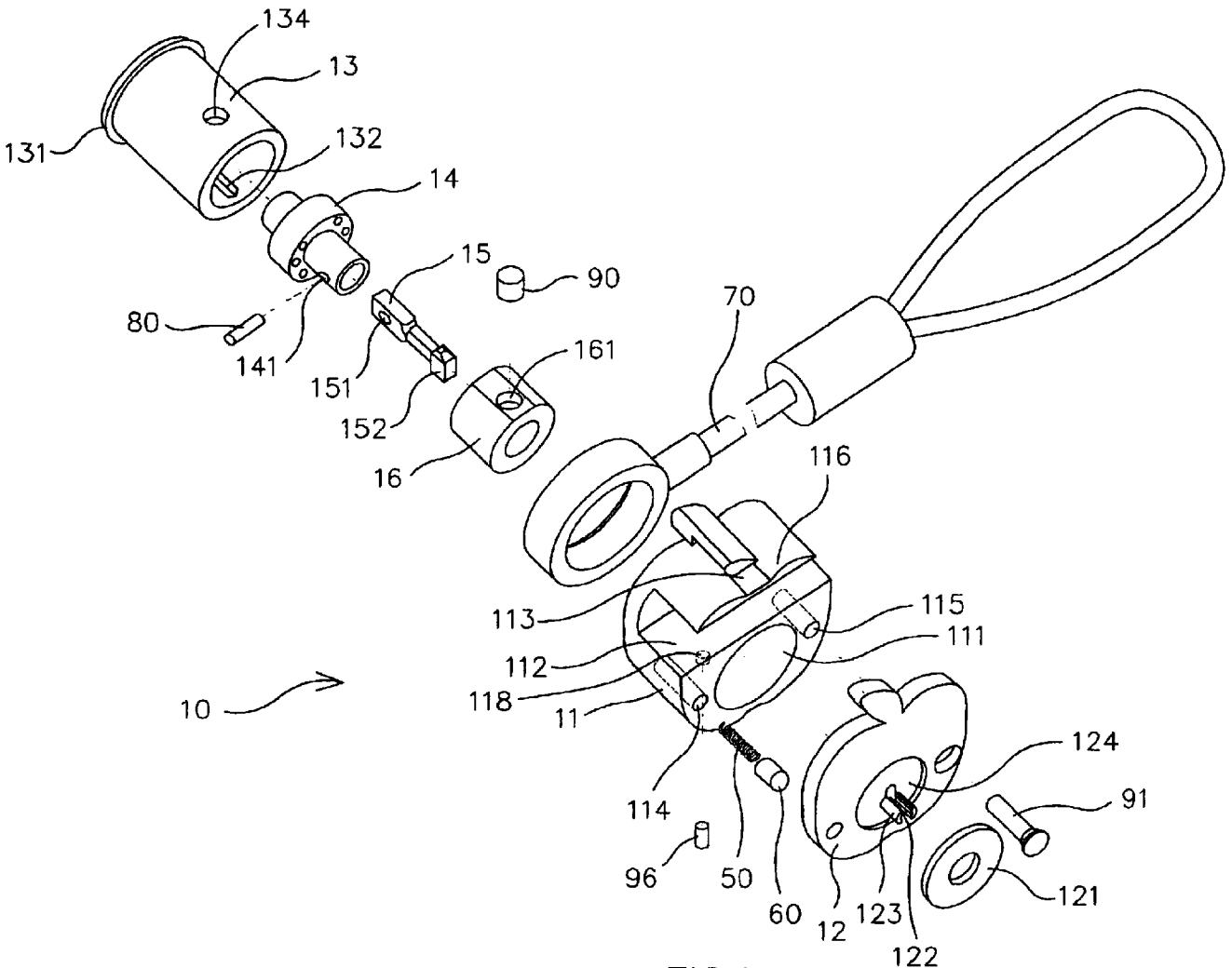
FIG. 2 is an exploded perspective view of the computer lock as shown in FIG. 1.
Figure 3:
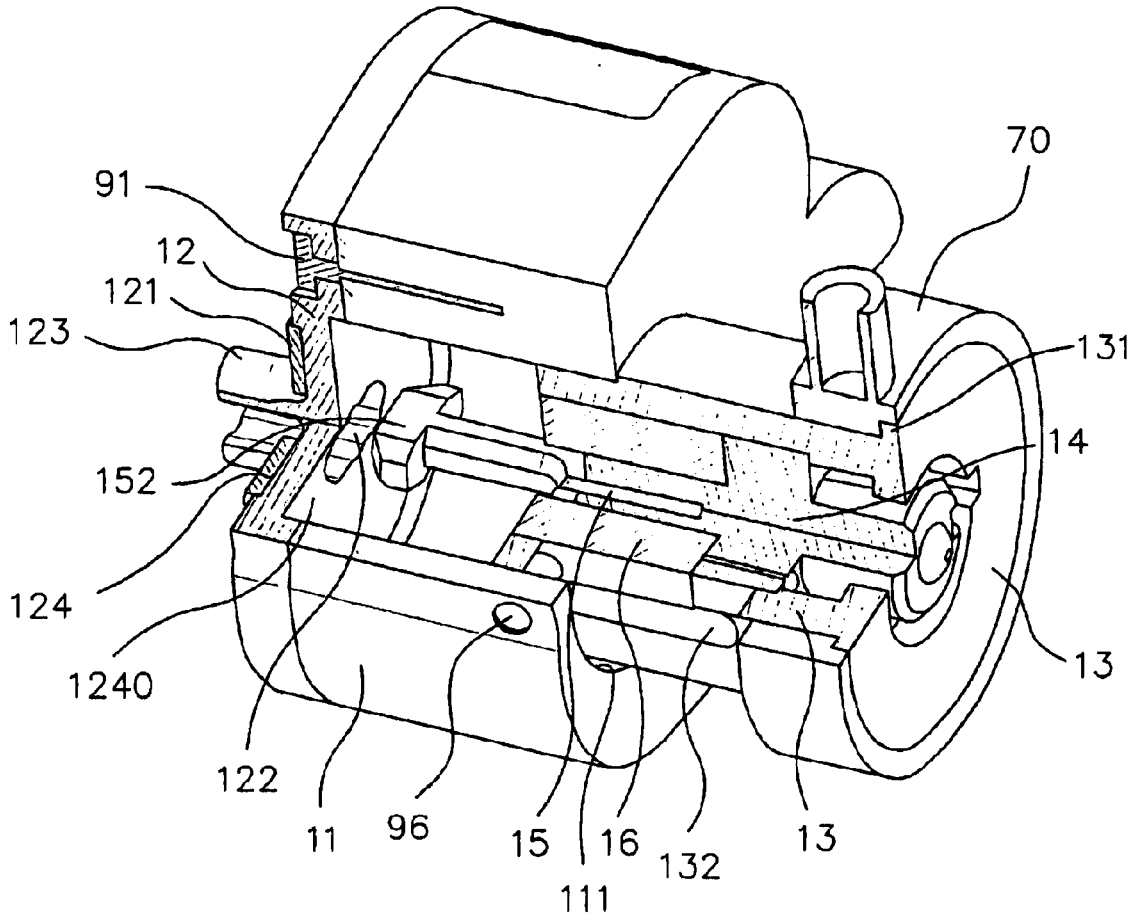
FIG. 3 is a partially cross-sectional view of the computer lock as shown in FIG. 1.

Referring to the drawings and initially to FIGS. 1–4, a computer lock 10 in accordance with the preferred embodiment of the present invention comprises a lock body 11, a cover 12, a lock core 13, an action body 14, an action shaft 15, and a locking block 16.

The lock body 11 has an irregular shape, and has an inside formed with a channel 111. The lock body 11 has a periphery formed with two U-shaped receiving slots 112 and 113 for receiving a power supply cord 30 (see FIG. 8) and other cords 40 (see FIG. 8) for the mouse, printer or the like. The periphery of the lock body 11 is formed with an insertion hole 118 for insertion of a slide 96. The lock body 11 has an end face formed with a shaft hole 115 for mounting a pivot shaft 91 and a receiving hole 114 for receiving a spring 50 and a pin 60 which is urged on the cover 12. The lock body 11 has a side face formed with a groove 116 for mounting a locking cord 70 which is used to lock the computer lock 10 on an article, such as a fixed upright or leg.

The cover 12 is apple-shaped and is pivotally mounted on the lock body 11 by the pivot shaft 91. The cover 12 has a first side formed with a first recessed zone 124 for mounting a pad 121 and a second side formed with a second recessed zone 1240. The cover 12 has a center formed with a through hole 122 and two symmetrical protruding limit bars 123 surrounding the through hole 122.

The lock core 13 having a cylindrical shape is movably mounted on the lock body 11, and has an end formed with a protruding catch flange 131 for stopping the locking cord 70. The lock core 13 has an inner wall formed with a slide slot 132 for slidably mounting the slide 96 of the lock body 11.

The action body 14 is rotatably mounted in the lock core 13. The action body 14 is a stepped tube and has a periphery formed with an insertion hole 141 for insertion of a locking pin 80.

The action shaft 15 is secured on the action body 14 to rotate therewith, and has a first end formed with a through hole 151 for passage of the locking pin 80 and a second end formed with an enlarged locking block 152 protruding outward from the action body 14 and the lock core 13 and received in the channel 111 of the lock body 11.

The locking block 16 is secured in the lock core 13 and rested on the action body 14 for limiting movement of the action body 14. The lock core 13 has an inner wall formed with a shoulder 136 and has a periphery formed with a positioning hole 134. The action body 14 has a first side rested on the shoulder 136 of the lock core 13 and a second side rested on the locking block 16, so that the action body 14 is limited by the shoulder 136 of the lock core 13 and the locking block 16. The locking block 16 has a tubular shape and has a periphery formed with a positioning hole 161 for mounting a plug 90 which is inserted into the positioning hole 134 of the lock core 13, so that the locking block 16 is secured in the lock core 13.

Figure 4:
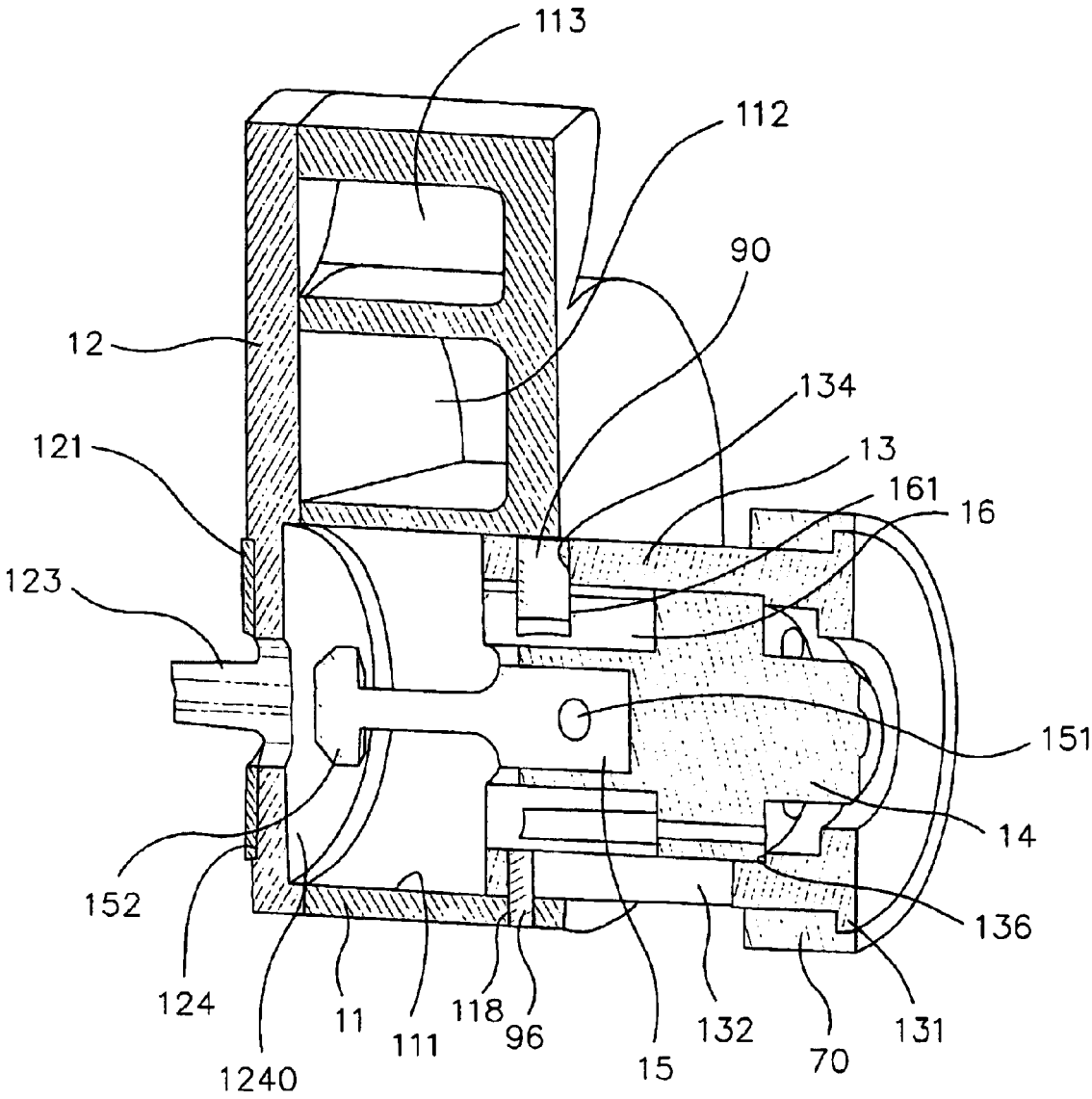
FIG. 4 is a cross-sectional view of the computer lock as shown in FIG. 1.
Figure 5:
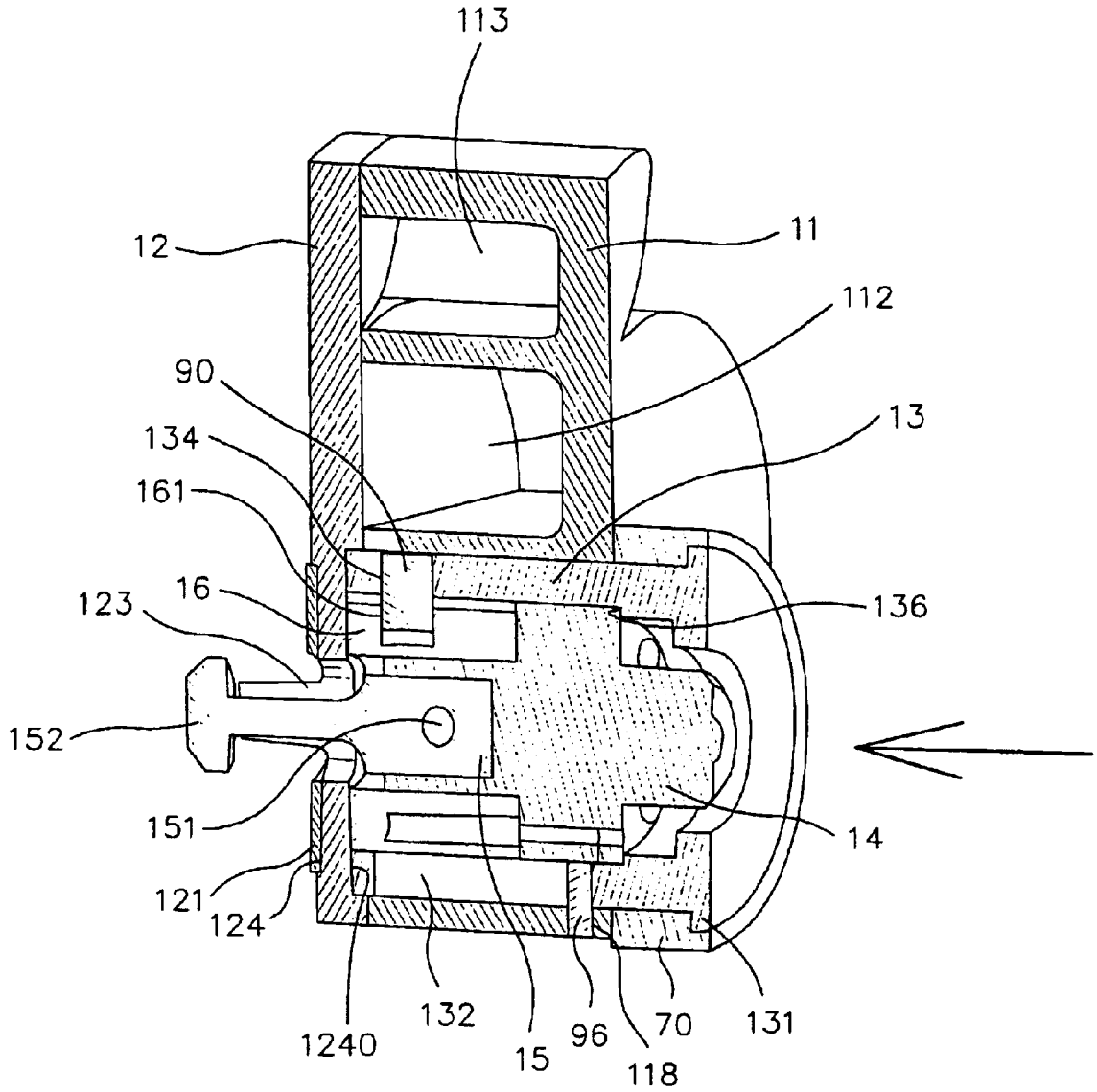
FIG. 5 is a schematic operational view of the computer lock as shown in FIG. 4 in use.
Figure 6:
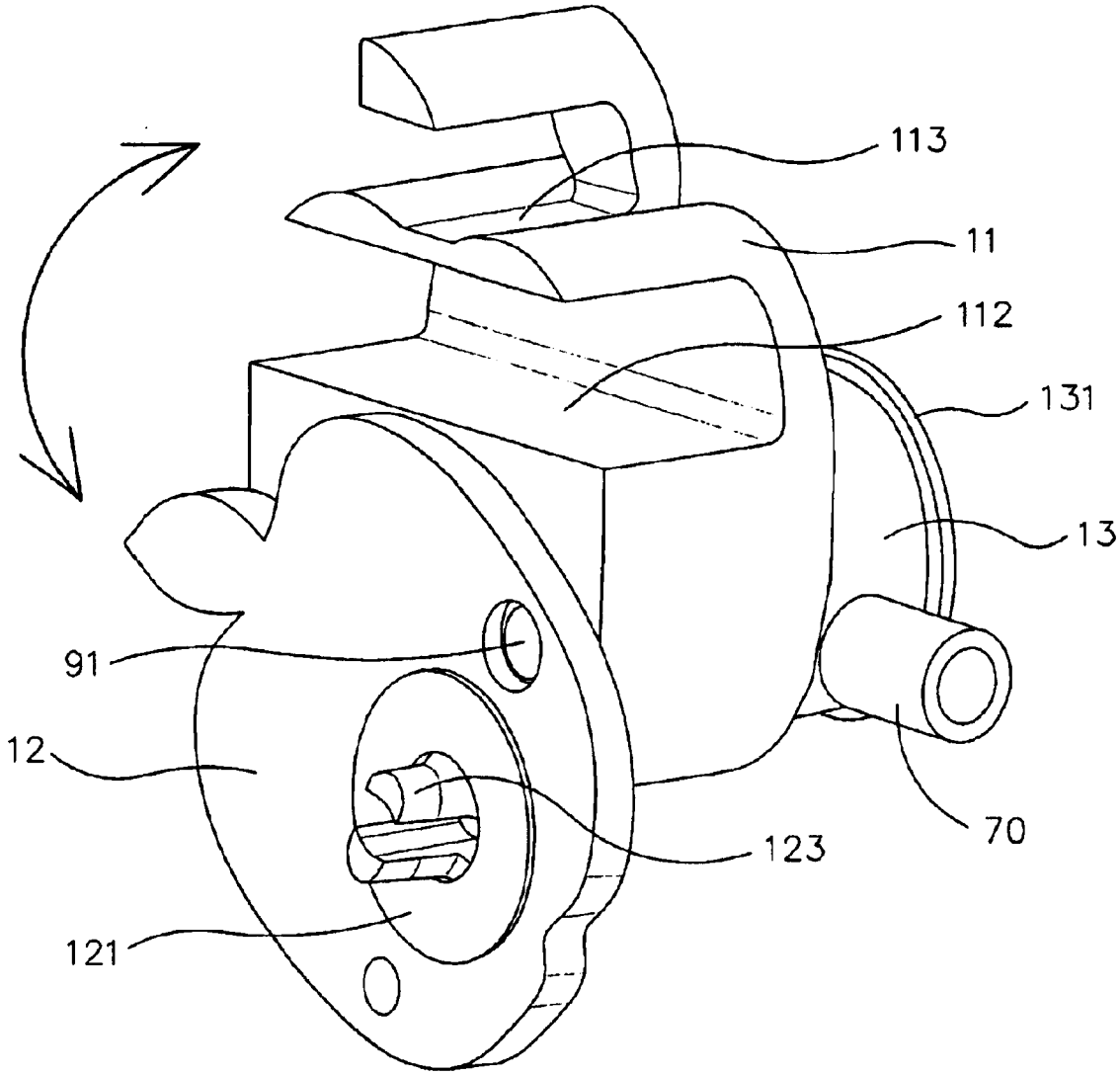
FIG. 6 is a schematic operational view of the computer lock as shown in FIG. 1 in use.
Figure 7:
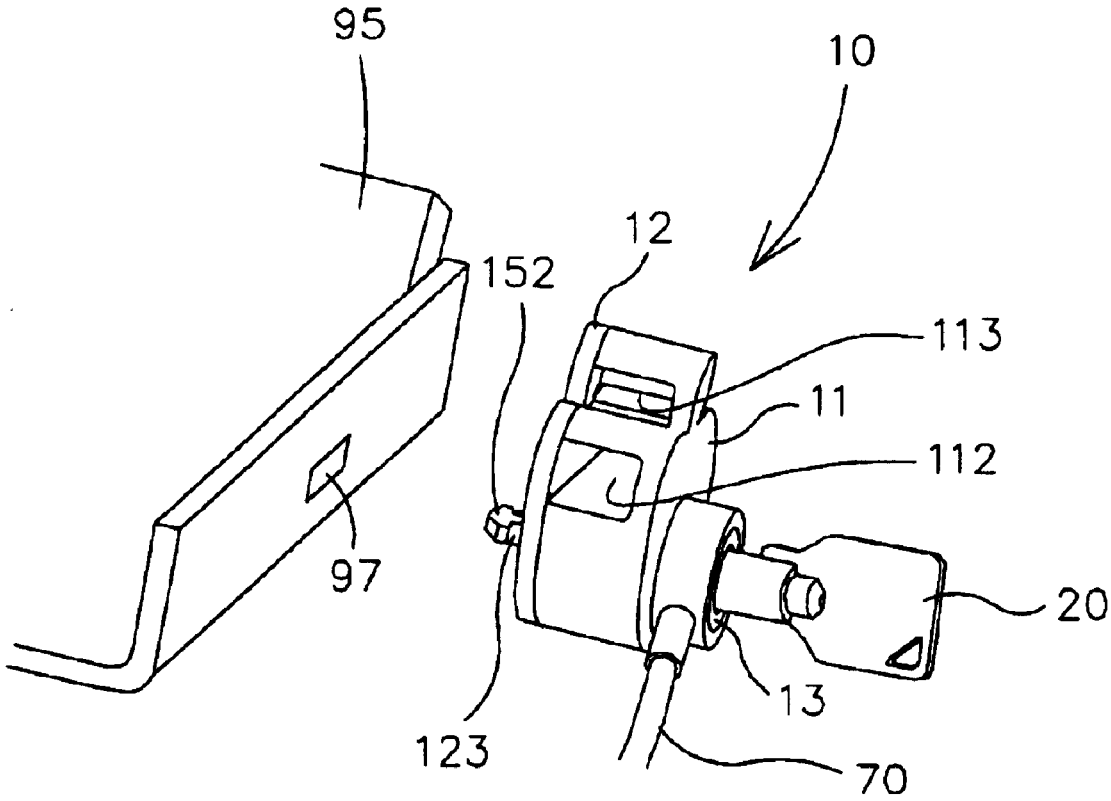
FIG. 7 is a perspective view showing usage of the computer lock in accordance with the preferred embodiment of the present invention.

In operation, referring to FIGS. 5–8 with reference to FIGS. 1–4, when the key 20 is inserted into a distal end of the lock core 13 as shown in FIG. 7, the action body 14 is pressed by the key 20 to move toward the lock body 11 and the cover 12. At this time, the lock core 13, the action body 14, the action shaft 15 and the locking block 16 are combined with each other, so that when the action body 14 is pressed, the lock core 13, the action body 14, the action shaft and the locking block 16 are pressed and moved toward the lock body 11 15 and the cover 12 synchronously, so as to move from the position as shown in FIG. 4 to the position as shown in FIG. 5, such that the locking block 152 of the action shaft 15 is pushed and moved to protrude outward from the two limit bars 123 of the cover 12 as shown in FIGS. 1 and 7.

Figure 8:
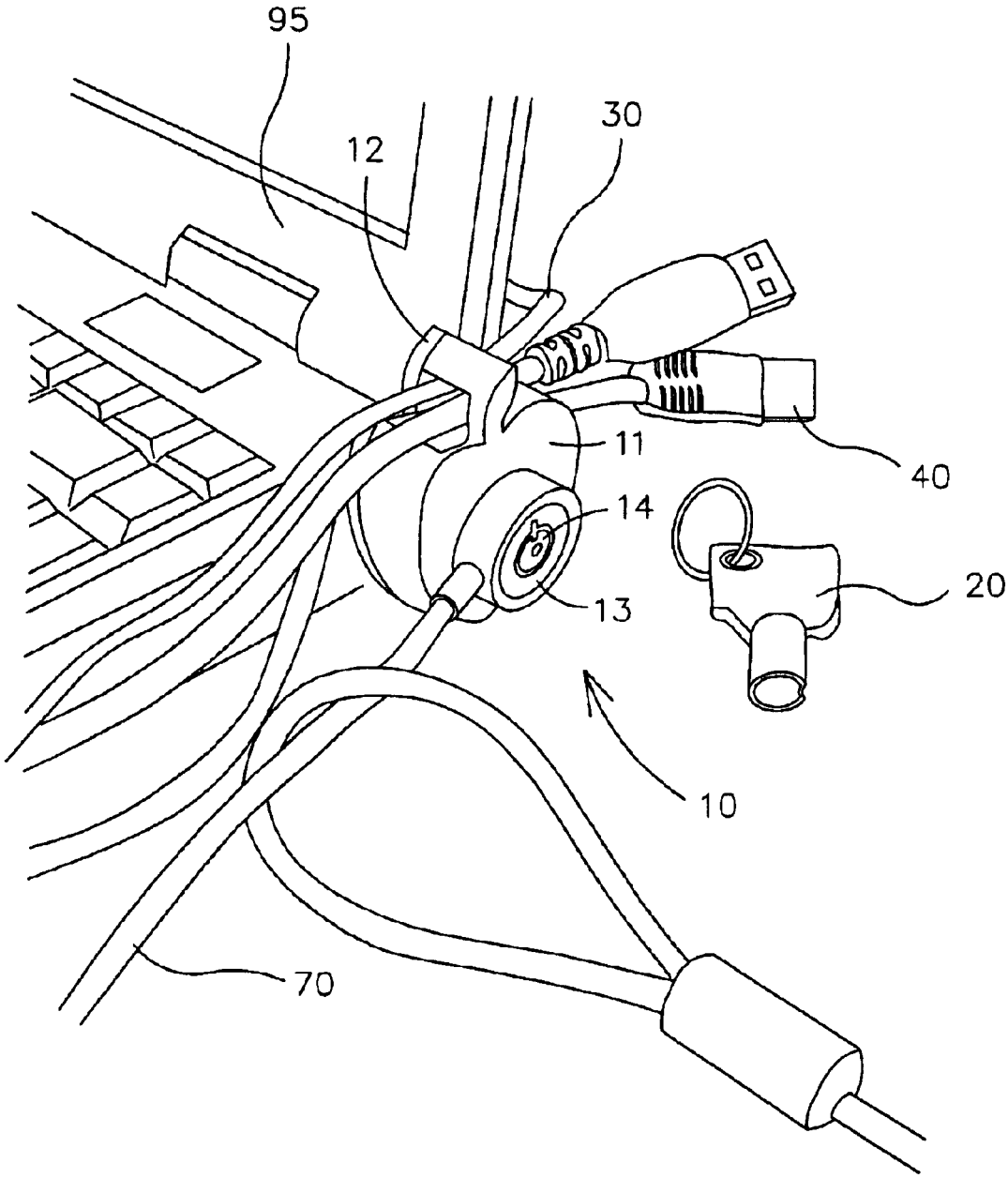
FIG. 8 is a perspective view showing usage of the computer lock in accordance with the preferred embodiment of the present invention.

Then, the locking block 152 of the action shaft 15 is inserted into the rectangular slot 97 of the notebook computer 95 as shown in FIG. 7. Then, the key 20 is rotated to rotate the action body 14 which rotates the action shaft 15, so that the locking block 152 of the action shaft 15 is rotated and is rested on and locked by a peripheral wall of the slot 97 of the notebook computer 95, such that the computer lock 10 is locked on the notebook computer 95 as shown in FIG. 8. Thus, the locking cord 70 can be wound around an article, such as a fixed upright or leg, so that the computer lock 10 and the notebook computer 95 are secured on the article so as to provide an anti-theft function.

In addition, when the lock core 13, the action body 14, the action shaft 15 and the locking block 16 are pressed and moved from the position as shown in FIG. 4 to the position as shown in FIG. 5, the lock core 13 and the locking block 16 are locked in the second recessed zone 1240 of the cover 12, so that the cover 12 is fixed on the lock body 11 and cannot be opened, thereby achieving the anti-theft function.

As shown in FIG. 6, before the key 20 is inserted into a distal end of the lock core 13, the locking block 152 of the action shaft 15 is received in the channel 111 of the lock body 11 and is not protruded outward from the two limit bars 123 of the cover 12 as shown in FIG. 4. Thus, the cover 12 is pivoted about the pivot shaft 91 to expose the two U-shaped receiving slots 112 and 113 for receiving the power supply cord 30 (see FIG. 8) and other cords 40 (see FIG. 8) for the mouse, printer or the like.

Accordingly, the computer lock 10 can be operated easily and conveniently, thereby facilitating the user operating the computer lock 10. In addition, the computer lock 10 can provide an anti-theft function so as to protect the notebook computer 95 efficiently. Further, the computer lock 10 has a simplified construction, thereby decreasing costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A computer lock, comprising a lock body, a cover, a lock core, an action body, an action shaft, and a locking block, wherein:

the lock body has an irregular shape, and has an inside formed with a channel, the lock body has a periphery formed with two U-shaped receiving slots for receiving a power supply cord and other cord, the periphery of the lock body is formed with an insertion hole for insertion of a slide, the lock body has an end face formed with a shaft hole for mounting a pivot shaft and a receiving hole for receiving a spring and a pin, the lock body has a side face formed with a groove for mounting a locking cord;

the cover is pivotally mounted on the lock body by the pivot shaft, the cover has a first side formed with a first recessed zone for mounting a pad and a second side formed with a second recessed zone, the cover has a center formed with a through hole and two symmetrical protruding limit bars surrounding the through hole;

the lock core is movably mounted on the lock body, and has an end formed with a protruding catch flange for stopping the locking cord, the lock core has an inner wall formed with a slide slot for slidably mounting the slide of the lock body;

the action body is rotatably mounted in the lock core and has a periphery formed with an insertion hole for insertion of a locking pin;

the action shaft is secured on the action body to rotate therewith, and has a first end formed with a through hole for passage of the locking pin and a second end formed with an enlarged locking block; and the locking block is secured in the lock core and rested on the action body for limiting movement of the action body.

2. The computer lock in accordance with claim 1, wherein the spring-biased pin is urged on the cover.

3. The computer lock in accordance with claim 1, wherein the cover is apple-shaped.

4. The computer lock in accordance with claim 1, wherein the lock core has a cylindrical shape.

5. The computer lock in accordance with claim 1, wherein the action body is a stepped tube.

6. The computer lock in accordance with claim 1, wherein the locking block of the action shaft protrudes outward from the action body and the lock core and is received in the channel of the lock body.

7. The computer lock in accordance with claim 1, wherein the lock core has an inner wall formed with a shoulder and has a periphery formed with a positioning hole, and the action body has a first side rested on the shoulder of the lock core and a second side rested on the locking block, so that the action body is limited by the shoulder of the lock core and the locking block.

8. The computer lock in accordance with claim 7, wherein the locking block has a tubular shape and has a periphery formed with a positioning hole for mounting a plug which is inserted into the positioning hole of the lock core, so that the locking block is secured in the lock core.

9. The computer lock in accordance with claim 1, wherein the action body, the action shaft and the locking block are combined with each other, so that when the action body is pressed to move toward the lock body and the cover, the lock core, the action body, the action shaft and the locking block are pressed and moved toward the lock body and the cover synchronously, such that the locking block of the action shaft is pushed and moved to protrude outward from the two limit bars of the cover.

10. The computer lock in accordance with claim 9, wherein when the lock core, the action body, the action shaft and the locking block are pressed and moved toward the lock body and the cover, the lock core and the locking block are locked in the second recessed zone of the cover, so that the cover is fixed on the lock body and cannot be opened.

11. The computer lock in accordance with claim 1, wherein the cover is pivoted about the pivot shaft to expose the two U-shaped receiving slots.

* * * * *